US011064800B1

(12) United States Patent
Malpede

(10) Patent No.: US 11,064,800 B1
(45) Date of Patent: Jul. 20, 2021

(54) TRAVEL TOOTHBRUSH

(71) Applicant: Nicholas Malpede, McLean, VA (US)

(72) Inventor: Nicholas Malpede, McLean, VA (US)

( * ) Notice: Subject to any disclaimer, the term of this patent is extended or adjusted under 35 U.S.C. 154(b) by 0 days.

(21) Appl. No.: 17/111,834

(22) Filed: Dec. 4, 2020

(51) Int. Cl.
*A46B 11/04* (2006.01)
*A46B 11/00* (2006.01)
*A46B 9/04* (2006.01)

(52) U.S. Cl.
CPC ..... *A46B 11/0041* (2013.01); *A46B 9/04* (2013.01); *A46B 11/002* (2013.01); *A46B 11/0003* (2013.01); *A46B 11/0062* (2013.01); *A46B 11/0065* (2013.01); *A46B 2200/1066* (2013.01)

(58) Field of Classification Search
CPC ..... A46B 11/0041; A46B 11/0062; A46B 11/0065; A46B 9/04
See application file for complete search history.

(56) References Cited

U.S. PATENT DOCUMENTS 2,888,696 A * 6/1959 Longert ..... A46B 11/0041 401/165
5,584,593 A * 12/1996 Lafortune ..... A46B 11/0003 401/184
6,257,791 B1 7/2001 Scamard
7,699,552 B2 * 4/2010 Grez ..... A46B 11/0055 401/155
8,087,843 B2 * 1/2012 Ottaviani ..... A46B 11/0079 401/188 R
8,540,448 B2 * 9/2013 Greene ..... A61C 17/22 401/188 R
8,544,480 B1 * 10/2013 Greene ..... A61C 15/046 132/309
9,144,298 B2 * 9/2015 Fattori ..... A46B 11/0041
9,930,957 B2 * 4/2018 Hellkamp ..... A61C 15/02
10,010,165 B1 * 7/2018 LaFortune ..... A46B 15/0091
2009/0144922 A1 * 6/2009 Pitaro Israel ..... A46B 11/0079 15/167.1
2014/0137350 A1 5/2014 Wen et al.
2017/0318950 A1 * 11/2017 Cope ..... A46B 9/04

FOREIGN PATENT DOCUMENTS

CN 202722954 U 2/2013
CN 105919271 A 9/2016
GB 2203636 A * 10/1988 ..... A46B 11/0041
GB 2375040 A * 11/2002 ..... A46B 15/0081
GB 2386828 A 10/2003

OTHER PUBLICATIONS

ZiTong Zhou et al., "Portable (Disposable) Toothbrush", Hubei University of Technology, undated.
Henry Hughes, "Tooth-O-Matic", Inventors Project, undated.

* cited by examiner

*Primary Examiner* — Jennifer C Chiang
(74) *Attorney, Agent, or Firm* — Venable LLP

(57) ABSTRACT

A toothbrush includes a toothbrush head having bristles and an interior opening for receiving toothpaste, a neck portion extending from the toothbrush head, with the neck portion including an interior channel connecting to the opening, and a handle portion extending from the neck portion. The handle portion includes an opening for receiving a toothpaste packet, a cavity for housing the toothpaste packet, and a compression section capable of compressing toothpaste contained in the cavity. The compression section includes an operable element configured to provide a lateral compression force.

21 Claims, 6 Drawing Sheets

TRAVEL TOOTHBRUSH

FIELD OF THE INVENTION

The present invention relates generally to a toothbrush, and more particularly to a toothbrush having self-contained toothpaste.

BACKGROUND OF THE INVENTION

Toothbrushes are generally well known. A conventional toothbrush includes a handle and an integral toothbrush head, with bristles supported by and extending from the toothbrush head for brushing a user's teeth.

In use, toothpaste from a tube is applied to the head of the toothbrush in order to use the toothbrush. When travelling or otherwise using the toothbrush away from home, both the toothbrush and the tube of toothpaste must be transported. This can make portability of the toothbrush cumbersome and inconvenient.

BRIEF SUMMARY OF THE INVENTION

It is an object of the invention to provide a portable toothbrush provided with its own supply of toothpaste, thus not requiring a separate tube of toothpaste and making it ideal for travel.

It is another object of the invention to provide a re-usable portable toothbrush, able to refill its self-contained supply of toothpaste.

In accordance with one aspect of the invention, a toothbrush comprises a toothbrush head including bristles and an interior opening for receiving toothpaste, a neck portion extending from the toothbrush head, with the neck portion including an interior channel connecting to the interior opening, and a handle portion extending from the neck portion. The handle portion includes an opening for receiving a toothpaste packet, a cavity for housing the toothpaste packet, and a compression section capable of compressing toothpaste contained in the cavity. The compression section includes an operable element configured to provide a lateral compression force.

In accordance with another aspect of the invention, a toothbrush comprises a toothbrush head including bristles and an interior opening for receiving toothpaste, a neck portion extending from the toothbrush head, with the neck portion including an interior channel connecting to the interior opening, and a handle portion extending from the neck portion. The handle portion includes a lateral face having an opening, a cavity for housing toothpaste, and a compression section capable of compressing toothpaste contained in the cavity. The compression section includes an operable element configured to provide a lateral compression force for extruding the toothpaste.

In accordance with another aspect of the invention, a toothbrush comprises a toothbrush head including bristles and an interior opening for receiving toothpaste, a neck portion extending from the toothbrush head, with the neck portion including an interior channel connecting to the interior opening, and a handle portion extending from the neck portion. The handle portion includes a cavity for housing a toothpaste packet, and a compression section capable of compressing toothpaste contained in the cavity. The compression section includes an operable element configured to provide a lateral compression force.

DETAILED DESCRIPTION OF THE INVENTION

Figure 1:
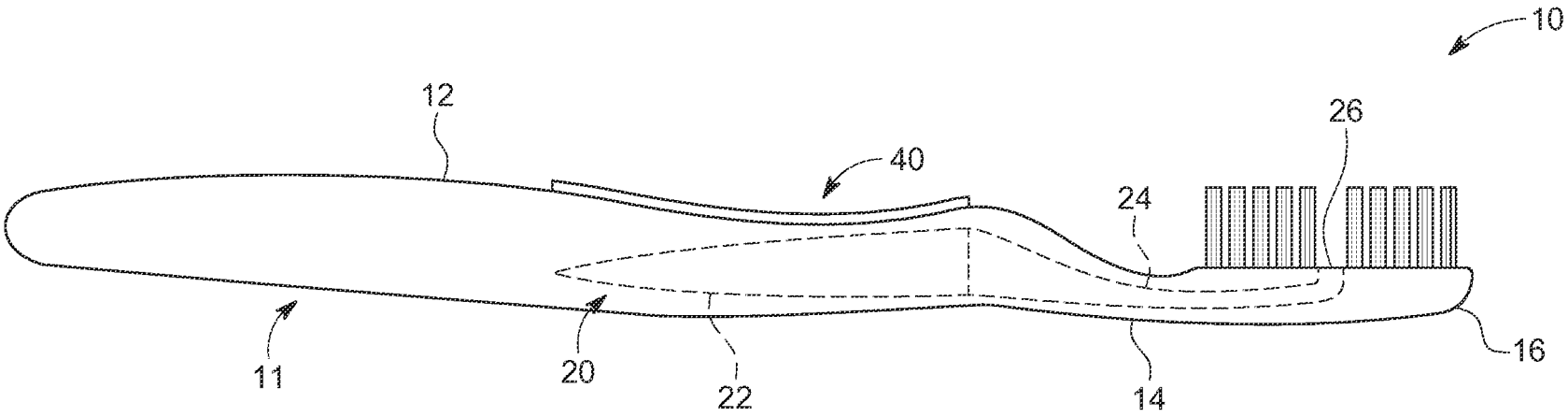
FIG. 1 is a side elevation view of the toothbrush in accordance with the invention.
Figure 2:
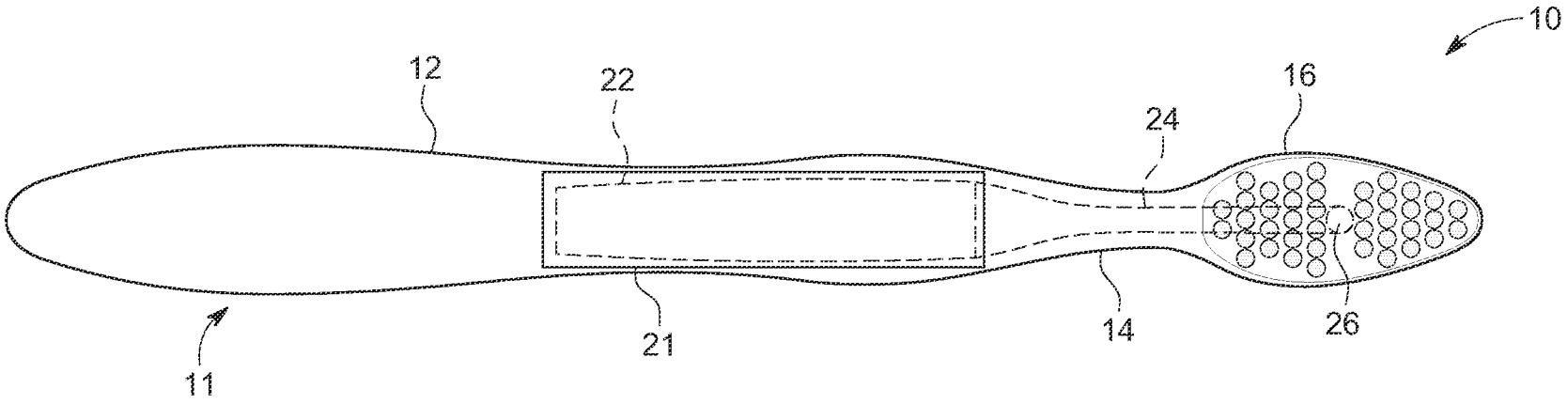
FIG. 2 is a top plan view of the toothbrush in accordance with the invention.

As illustrated in FIGS. 1 and 2, a toothbrush 10 in accordance with the invention includes a body 11 having a handle portion 12, a neck portion 14, and a toothbrush head 16. While these elements are preferably contiguously connected as a single element, it is within the scope of this invention to provide separate elements connectable together.

The body is provided with a hollow cavity 20 for receiving and containing a toothpaste packet, describe below. The cavity is accessed from an opening 21 in the handle portion, as shown in FIG. 2, and includes a main hollow 22 for housing a main body of the toothpaste packet and continues with a channel 24 extending through the neck portion and terminating at an orifice 26 in the toothbrush head.

Figure 3:
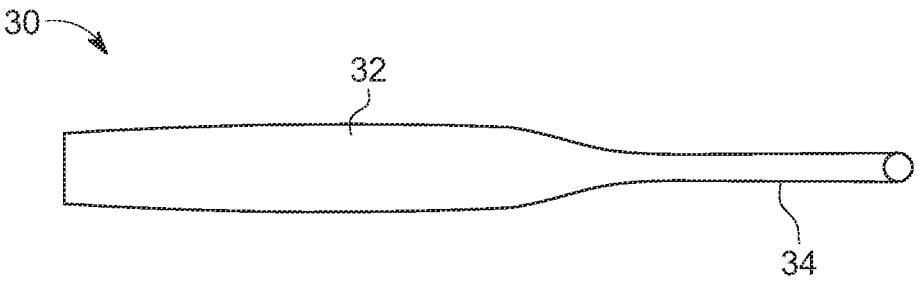
FIG. 3 is a top plan view of a toothpaste packet in accordance with the invention.

A toothpaste packet 30 in accordance with the invention is shown in FIG. 3. The toothpaste packet includes a main body 32 in which the toothpaste is contained and an extended neck 34 that provides a passage for the toothpaste to travel to the orifice and into the toothbrush head. As will be appreciated, the toothpaste packet is shaped generally to fit within the hollow cavity 20 of the toothbrush, and while they are preferably shaped to complement each other, the particular shape of the cavity and toothpaste packet can vary.

The toothpaste packet itself can be made of conventional materials, e.g., sheets of plastic laminate and aluminum laminate pressed together in a film. A high-density polyethylene, or HDPE, could also be used. The toothpaste packet should also be pliable and collapsible, allowing for the toothpaste, which is preferably a viscous liquid, to be extruded by squeezing the tube.

The body of the toothbrush also includes a compression section 40, shown generally in FIG. 1, providing an operable element for compressing the toothpaste in the packet. This is accomplished by applying a lateral compression force against the main body of the toothpaste packet. The compression section is configured to fit within or over the opening 21. With this arrangement, the hollow cavity can be readily accessed for inserting new toothpaste packets into the toothbrush and removing empty toothpaste packets from the toothbrush.

Figure 4:
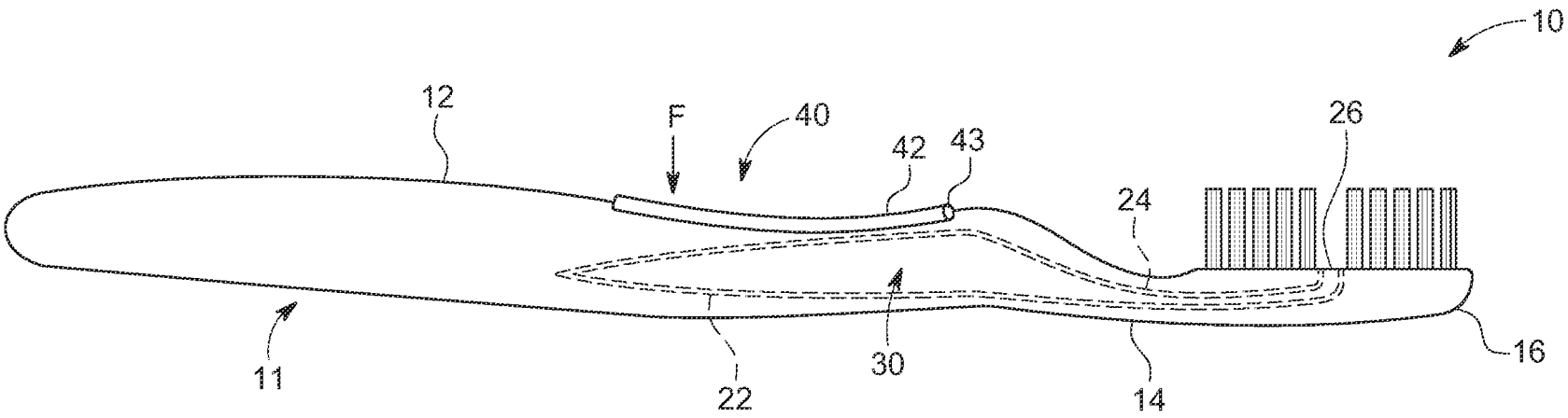
FIG. 4 is a side elevation view of the toothbrush and toothpaste packet in accordance with a first embodiment of the invention.

FIG. 4 illustrates one embodiment of the invention showing the compression section to comprise a lever 42 as the operable element. The lever has a generally rectangular-shaped pad approximating the size and shape of the opening 21, albeit slightly smaller, so as to be able to pivot into the opening. The lever itself can be made of a rigid material or, alternatively, a flexible material.

As illustrated, the lever is pivotably-connected at its proximal end 43 to the handle 12 and can be raised and lowered relative to the opening. In its raised position (unshown), access to the opening 21 is readily available, making it possible to insert or remove the toothpaste packet 30.

Figure 5A:
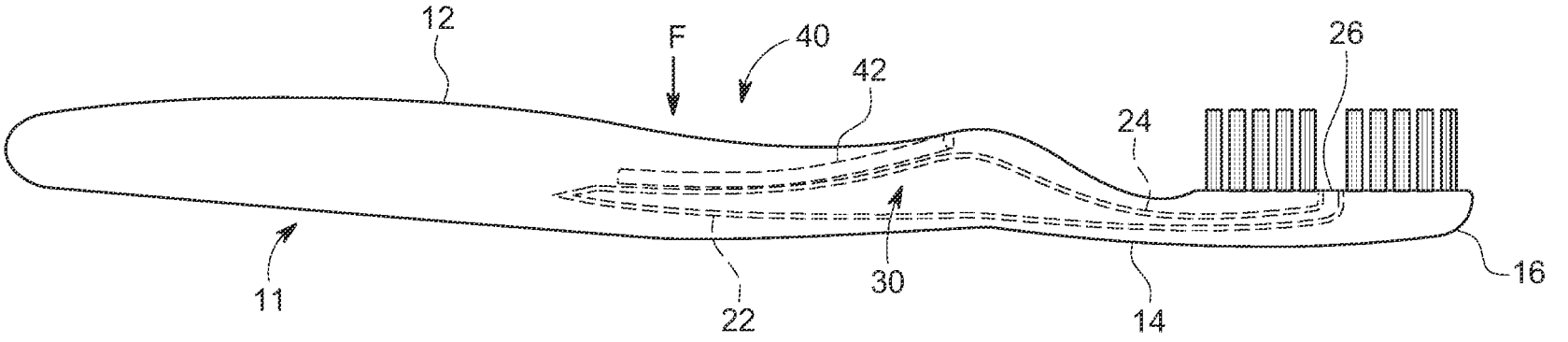
FIG. 5A is a side elevation view of the toothbrush with a partially depressed operable element in accordance with the first embodiment of the invention.

FIG. 5A illustrates the lever in a lowered, or depressed, position, with the lever fitting within the opening and able to apply the lateral compression force to the toothpaste packet.

By applying a lateral force to the lever, such as by the thumb of the user, in the direction of Arrow F, the lever rotates about the pivoting end 43. With this movement, a lateral compression force is applied to the toothpaste packet, and toothpaste is forced through the extended neck portion 14 by way of the channel 24 and into the toothbrush head 16 through the orifice 26. As the lever pivots downward, the lateral compression force moves axially along the handle portion.

Figure 5B:
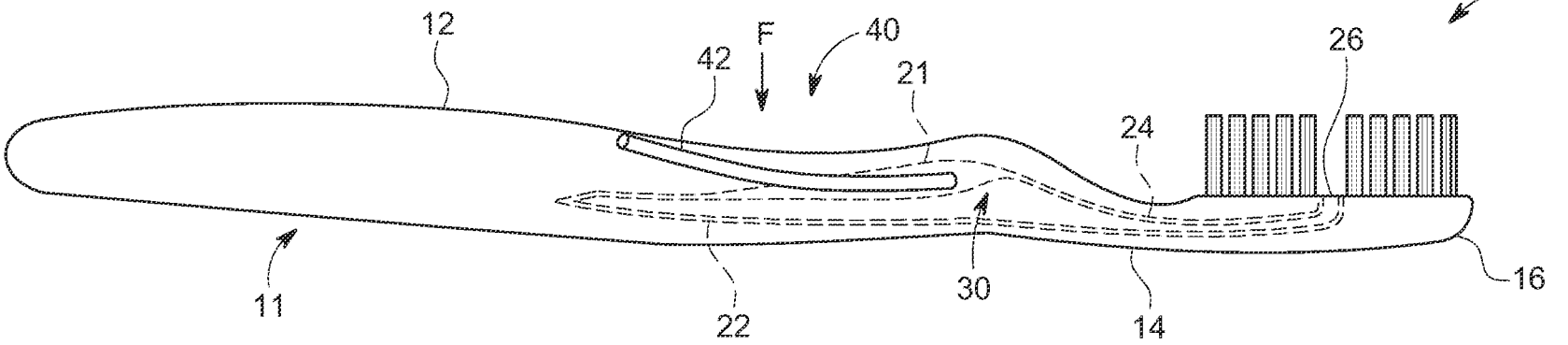
FIG. 5B is a schematic side elevation view of the toothbrush with a partially depressed operable element in accordance with a modification of the first embodiment of the invention.

As will be appreciated, in a modified arrangement the lever can be designed to pivot from its distal end, as illustrated in FIG. 5B, instead of the proximal end shown in FIG. 5A.

The shape of the operable element is also such that compression of the toothpaste packet is optimized, so as much toothpaste as possible can be extruded from the toothpaste packet as the lever is depressed. For example, the distal end of the lever 42 can be thicker (top to bottom) than the proximal end for earlier contact of the toothpaste packet as the lever pivots from its proximal end. By providing such a 'wedge-shaped' lever, toothpaste extrusion can be improved.

Figure 6A:
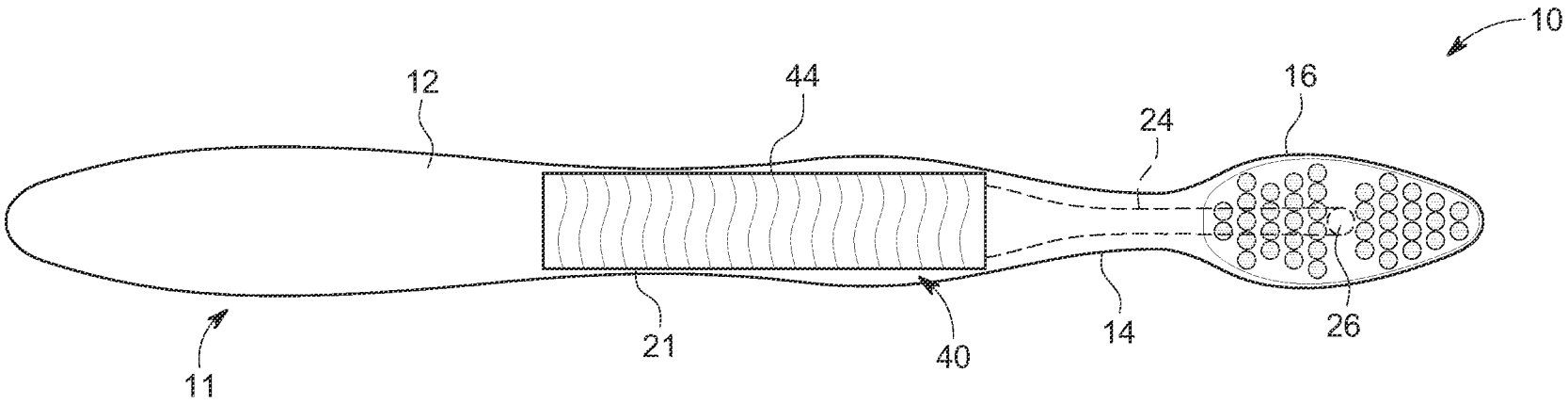
FIG. 6A is a top plan view of the toothbrush in accordance with a second embodiment of the invention.

FIG. 6A shows an alternative operable element. In this embodiment, the operable element is not pivotably-connected to the handle but rather is fitted within or over the opening. In more detail, a pad 44 fits securely with but removably from the handle opening 21. The pad is preferably comprised of, for example, an elastomer material, such as silicon, for flexibility so it can be compressed by the user to contact the toothpaste packet and apply the lateral compression force to the toothpaste packet.

The pad is also preferably removable to readily allow access to the opening for inserting/replacing the toothpaste packet. As will be appreciated, however, a pad that is not removable is also within the scope of the invention With this configuration, a toothpaste packet can be loaded through the opening and into the cavity, with the extended neck 34 being fed though the channel. In use, a lateral compression force is applied by the user, for example by the user's thumb pressing against the pad, to compress the toothpaste packet. This forces toothpaste through the extended neck and through the orifice, thus entering the toothbrush head. By moving the thumb axially along the pad and pressing against the pad, the lateral compression force can be applied axially along the handle portion, optimizing toothpaste extrusion.

Figure 6B:
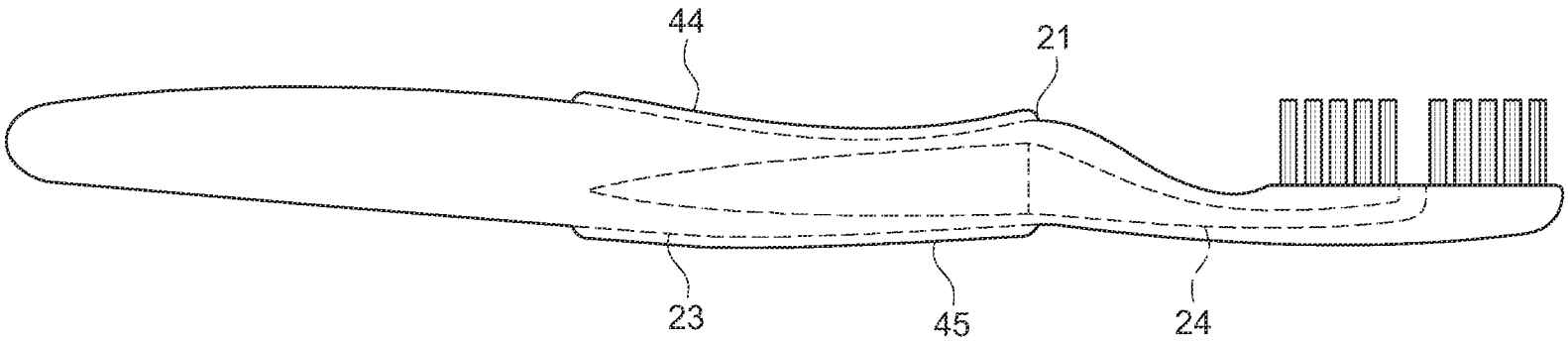
FIG. 6B is a side elevation view of the toothbrush in accordance with a modification of the second embodiment of the invention.

As a further alternative, as shown in FIG. 6B a second pad 45 can be provided in a second opening 23 located generally opposite to the opening 21 in the handle portion. In this way lateral compression can be applied to two sides of the toothpaste packet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A toothbrush, comprising:

a toothbrush head including bristles and an interior opening for receiving toothpaste;

a neck portion extending from the toothbrush head, the neck portion including an interior channel connecting to the interior opening; and a handle portion extending from the neck portion, the handle portion including a cavity for housing toothpaste, and a compression section capable of compressing toothpaste contained in the cavity, wherein the compression section includes operable elements configured to provide a lateral compression force, with the operable elements including a first pad fitting over a first opening in the handle portion and a second pad fitting over a second opening in the handle portion opposite to the first opening, with the first and second pads capable of applying a lateral compression force.

2. The toothbrush according to claim 1, wherein the first and second pads are compressible to apply the lateral compression force toward each other.

3. The toothbrush according to claim 1, wherein at least one of the first or second pads is removable.

4. The toothbrush according to claim 1, wherein the handle includes an opening for receiving a toothpaste packet.

5. A toothbrush assembly, comprising:

a toothbrush having a toothbrush head including bristles and an interior opening for receiving toothpaste, a neck portion extending from the toothbrush head, the neck portion including an interior channel connecting to the interior opening, a handle portion extending from the neck portion, the handle portion including a lateral face having an opening, a cavity for housing toothpaste, and a compression section capable of compressing toothpaste contained in the cavity; and a toothpaste packet contained in the cavity for supplying toothpaste to the toothbrush head, wherein the compression section includes operable elements configured to provide a lateral compression force against the toothpaste housed in the cavity, with the operable elements including a first pad fitting over the opening and a second pad fitting over a second opening in the handle portion opposite to the first opening, with the first and second pads capable of applying a lateral compression force to the toothpaste packet.

6. The toothbrush assembly according to claim 5, wherein the first and second pads are compressible to apply the lateral compression force.

7. The toothbrush assembly according to claim 5, wherein at least one of the first and second pads are removable.

8. The toothbrush assembly according to claim 7, wherein the toothpaste packet extends through the neck portion and terminates at the toothbrush head.

9. A toothbrush assembly, comprising:

a toothbrush having a toothbrush head including bristles and an interior opening for receiving toothpaste, a neck portion extending from the toothbrush head, the neck portion including an interior channel connecting to the interior opening, a handle portion extending from the neck portion, the handle portion including a cavity for housing a toothpaste packet, and a compression section capable of compressing toothpaste contained in the cavity; and a toothpaste packet contained in the cavity for supplying toothpaste to the toothbrush head, wherein the compression section includes an operable element configured to provide a lateral compression force against the toothpaste packet, with the compression force moving axially along the handle portion as the operable element is actuated.

10. The toothbrush assembly according to claim 9, wherein the operable element includes a pad fitting over the opening and compressible to apply the lateral compression force.

11. The toothbrush assembly according to claim 9, wherein the operable element is hinged at one end to apply the lateral compression force.

12. The toothbrush assembly according to claim 9, wherein the toothpaste packet includes a body extending axially within the handle portion, and the lateral compression force is applied axially along the toothpaste packet body.

13. The toothbrush assembly according to claim 9, wherein the operable element is actuated by a force along a single axis to impart the axially moving force.

14. The toothbrush according to claim 11, wherein the operable element is hinged at its distal end.

15. The toothbrush according to claim 11, wherein the operable element is hinged at its proximal end.

16. A toothbrush, comprising:

a toothbrush head including bristles and an interior opening for receiving toothpaste;

a neck portion extending from the toothbrush head, the neck portion including an interior channel connecting to the interior opening;

a handle portion extending from the neck portion, the handle portion including a lateral face having an opening, a cavity for housing toothpaste, and a compression section capable of compressing toothpaste contained in the cavity, wherein the compression section includes an operable element configured to provide a lateral compression force against toothpaste housed in the cavity, with the compression force moving axially along the handle portion as the operable element is actuated.

17. The toothbrush according to claim 16, wherein the operable element includes a pad fitting over the opening and compressible to apply the lateral compression force.

18. The toothbrush according to claim 16, wherein the operable element is hinged at one end to apply the lateral compression force.

19. The toothbrush according to claim 18, wherein the operable element is hinged at its distal end.

20. The toothbrush according to claim 18, wherein the operable element is hinged at its proximal end.

21. The toothbrush according to claim 16, wherein the operable element is actuated by a force along a single axis to impart the axially moving force.

* * * * *